US007429017B2

(12) United States Patent
Higgins et al.

(10) Patent No.: US 7,429,017 B2
(45) Date of Patent: Sep. 30, 2008

(54) EJECTABLE AERODYNAMIC STABILITY AND CONTROL

(75) Inventors: Kevin J. Higgins, Tucson, AZ (US); Charles D. Lyman, Tucson, AZ (US); Mark L. Bouchard, Tucson, AZ (US); Aaron C. Heidel, Tucson, AZ (US); Matthew B. Castor, Tucson, AZ (US)

(73) Assignee: Raytheon Company, Waltham, MA (US)

( * ) Notice: Subject to any disclaimer, the term of this patent is extended or adjusted under 35 U.S.C. 154(b) by 0 days.

(21) Appl. No.: 11/186,614

(22) Filed: Jul. 21, 2005

(65) Prior Publication Data

US 2007/0102568 A1 May 10, 2007

(51) Int. Cl.
*F42B 10/06* (2006.01)

(52) U.S. Cl. ..... 244/3.25; 244/3.24

(58) Field of Classification Search ..... 244/3.24, 244/3.25, 3.27, 49, 75.1
See application file for complete search history.

(56) References Cited

U.S. PATENT DOCUMENTS 2,597,703 A * 5/1952 Busacker ..... 244/3.25
4,145,017 A * 3/1979 Stiklorus ..... 244/3.25
4,930,398 A * 6/1990 Sharples ..... 89/1.51
5,048,773 A * 9/1991 Washington et al. ..... 244/3.28
5,642,867 A * 7/1997 Klestadt ..... 244/49
6,460,807 B1 * 10/2002 Braitinger et al. ..... 244/133
7,114,685 B1 * 10/2006 Schulein ..... 244/199.1

OTHER PUBLICATIONS

Washinton, "AIAA 93-0035" "Grid fins—a new concept for missile stability", Jan. 11-14, 1993.*

* cited by examiner

*Primary Examiner*—Rob Swiatek
(74) *Attorney, Agent, or Firm*—Noblitt & Gilmore, LLC

(57) ABSTRACT

The disclosed system and method for improving aerodynamic stability of aeronautic vehicles generally includes an ejectable grid fin adapted for releasable engagement with aeronautic vehicles. The grid fin is generally configured to optimize the flight performance characteristics of the aeronautic vehicle taken in engaged combination with the grid fin as compared with the flight performance of the aeronautic vehicle taken alone. Disclosed features and specifications may be controlled, adapted or otherwise optionally modified to improve the aerodynamic stability and/or control of a variety of deployed aeronautic vehicles. Exemplary embodiments of the present invention generally provide ejectable grid fins that may be used in conjunction with missiles mounted on an eject rail of an aircraft.

21 Claims, 3 Drawing Sheets

EJECTABLE AERODYNAMIC STABILITY AND CONTROL

This invention was made with United States Government support under Contract number F08635-03-C-0002 awarded Department of the Air Force. The United States Government has certain rights in this invention.

FIELD OF INVENTION

The present invention generally provides systems, devices and methods for aerodynamic lifting and control; and more particularly, representative and exemplary embodiments of the present invention generally relate to ejectable grid fins for use with aerodynamic vehicles.

BACKGROUND OF INVENTION

Conventional grid fins are disclosed in American Institute of Aeronautics and Astronautics paper AIAA 93-0035, entitled "Grid Fins—A New Concept for Missile Stability and Control", by W. D. Washington (U.S. Army Missile Command, Redstone Arsenal, Ala.), originally presented at the 31 rst Aerospace Sciences Meeting and Exhibit in January 1993.

Conventional fins have been used to stabilize and control missiles as well as other aeronautic vehicles. These fins are generally planar and are usually mounted on a missile body in alignment with the velocity airflow vector. Such configurations typically operate to produce lift and/or other control forces when rotated substantially out of alignment with the velocity airflow vector or when set at an angle incident to the velocity airflow vector.

There are several limitations associated with conventional fins and grid fin assemblies. Accordingly, there is a need for a grid fin that demonstrates improved characteristics and capabilities in terms of aeronautic vehicle deployment as well as aerodynamic stability and control.

SUMMARY OF THE INVENTION

In various representative aspects, the present invention provides an ejectable grid fin assembly for use with aeronautic vehicles. Exemplary features generally include a grid array structure adapted for releasable engagement with, for example, a missile. The grid array may be configured with a plurality of grid cell turbulation surfaces to provide control forces for altering the flight performance characteristics of the combination of the grid fin with the missile as compared with the flight performance characteristics of the missile by itself.

Advantages of the present invention will be set forth in the Detailed Description which follows and may be apparent from the Detailed Description or may be learned by practice of exemplary embodiments of the invention. Still other advantages of the invention may be realized by means of any of the instrumentalities, methods or combinations particularly pointed out in the claims.

BRIEF DESCRIPTION OF THE DRAWINGS

Representative elements, operational features, applications and/or advantages of the present invention reside inter alia in the details of construction and operation as more fully hereafter depicted, described and claimed—reference being made to the accompanying drawings forming a part hereof, wherein like numerals refer to like parts throughout. Other elements, operational features, applications and/or advantages will become apparent in light of certain exemplary embodiments recited in the Detailed Description, wherein:

Figure 1:
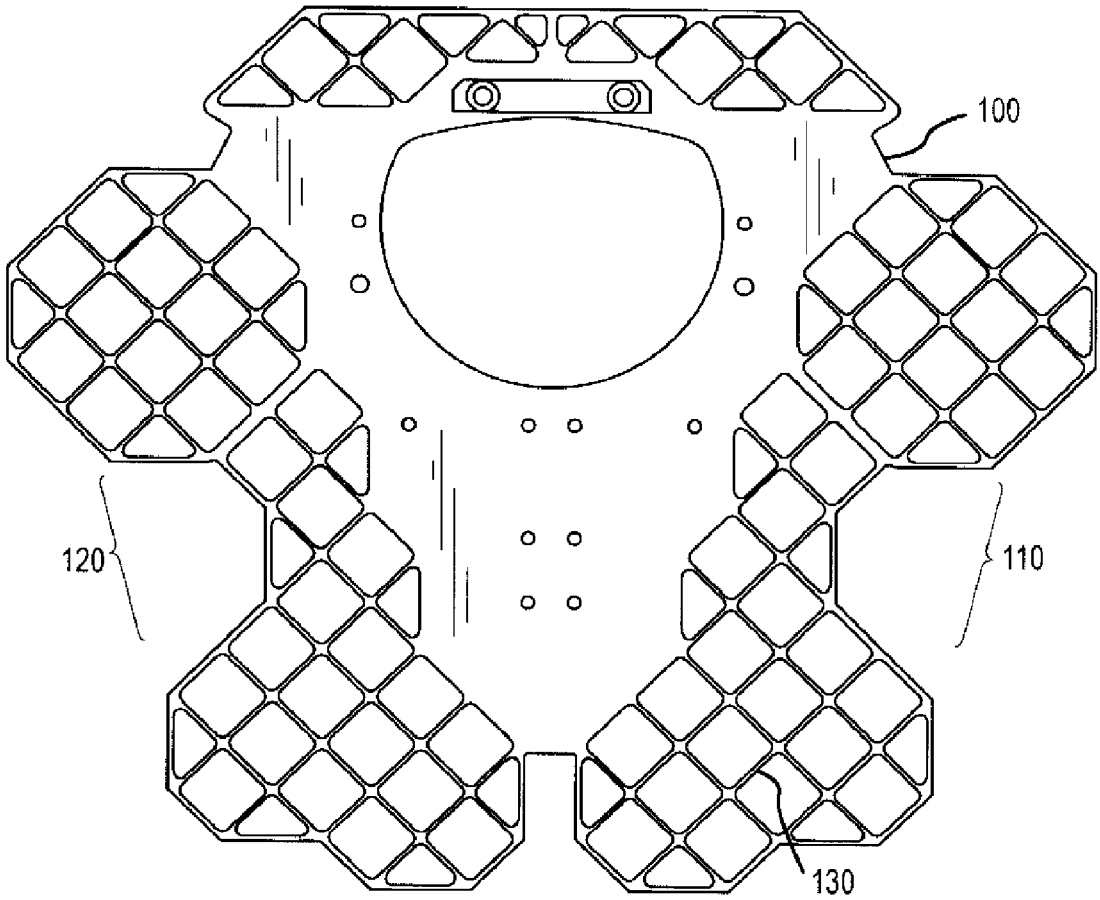
FIG. 1 representatively illustrates a plan view of a grid fin assembly in accordance with an exemplary embodiment of the present invention.
Figure 2:
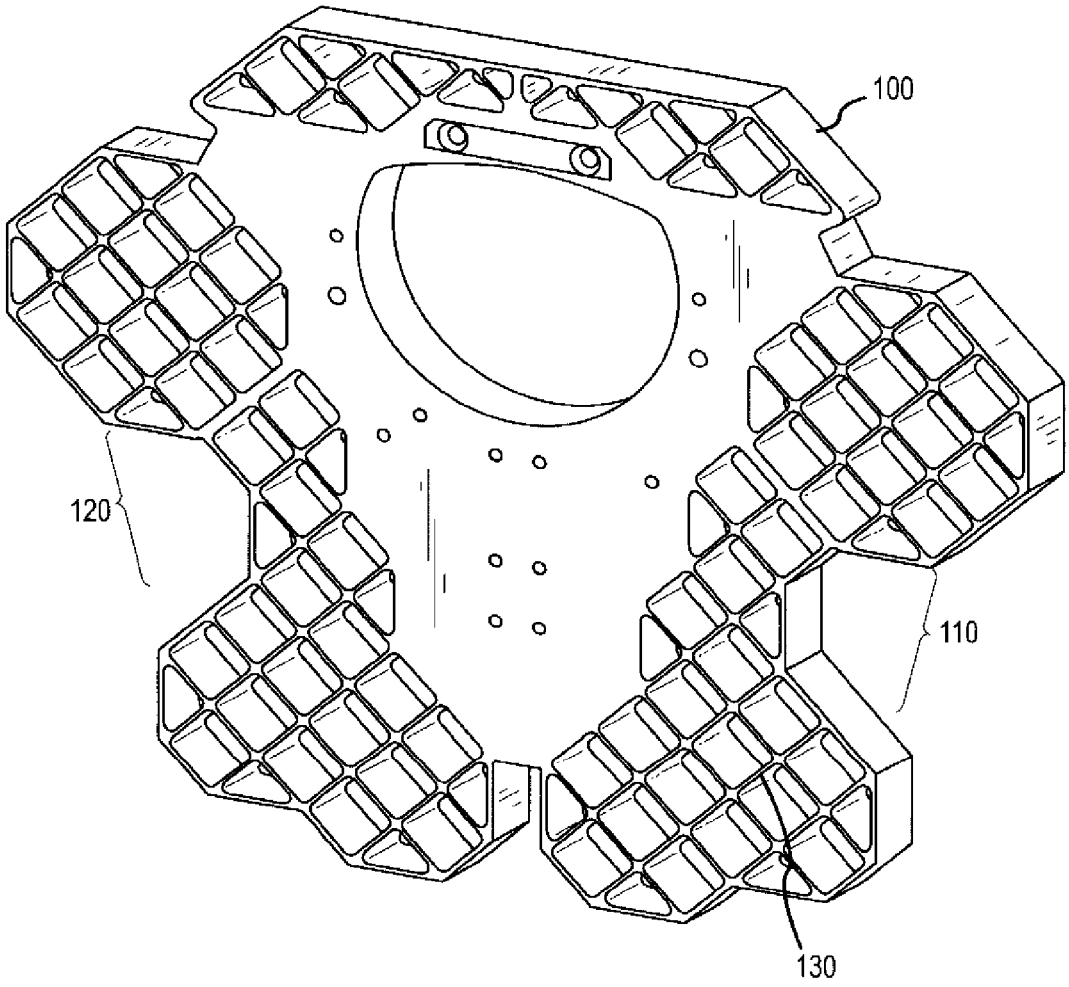
FIG. 2 representatively illustrates an isometric view of the grid fin assembly generally depicted in FIG. 1.
Figure 3:
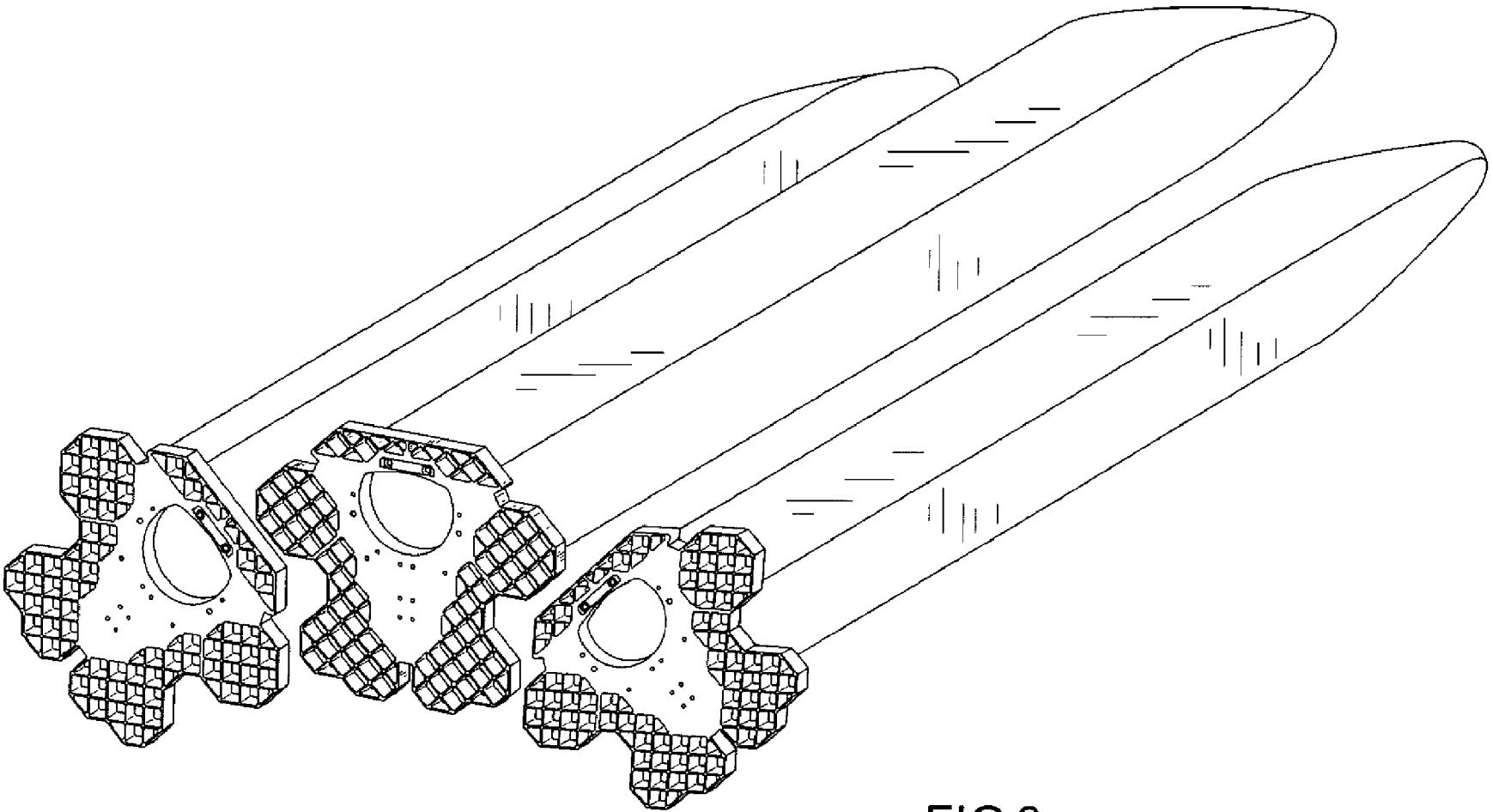
FIG. 3 representatively illustrates an isometric view of a plurality of grid fin assemblies coupled to a plurality of aeronautic vehicles in accordance with an exemplary embodiment of the present invention.

Elements in the Figures are illustrated for simplicity and clarity and have not necessarily been drawn to scale. For example, the dimensions of some of the elements in the Figures may be exaggerated relative to other elements to help improve understanding of various embodiments of the present invention. Furthermore, the terms "first", "second", and the like herein, if any, are used inter alia for distinguishing between similar elements and not necessarily for describing a sequential or chronological order. Moreover, the terms "front", "back", "top", "bottom", "over", "under", and the like in the Description and/or in the claims, if any, are generally employed for descriptive purposes and not necessarily for comprehensively describing exclusive relative position. Any of the preceding terms so used may be interchanged under appropriate circumstances such that various embodiments of the invention described herein may be rendered capable of operation in other configurations and/or orientations than those explicitly illustrated or otherwise described.

DETAILED DESCRIPTION OF EXEMPLARY EMBODIMENTS

The following representative descriptions of the present invention generally relate to exemplary embodiments and the inventors' conception of the best mode, and are not intended to limit the applicability or configuration of the invention in any way. Rather, the following description is intended to provide convenient illustrations for implementing various embodiments of the invention. As will become apparent, changes may be made in the function and/or arrangement of any of the elements described in the disclosed exemplary embodiments without departing from the spirit and scope of the invention.

A detailed description of an exemplary embodiment, namely an ejectable grid fin adapted for releasable engagement with a missile, is provided as a specific enabling disclosure that may be generalized to any application of the disclosed system, device and method for improving aerodynamic stability and/or control of an aeronautic vehicle in accordance with various other embodiments of the present invention.

In accordance with a representative and exemplary embodiment, the present invention allows missiles to be safely launched and separated from an aircraft. Thereafter, the disclosed stability augmentation device (e.g., grid fin) may be jettisoned such that subsequent flight performance is not negatively affected.

Many aerodynamic structures (conventional fins, ballutes, etc.) have been previously employed to improve the stability of a vehicle in a launched configuration; however, conventional aerodynamic structures have not provided stability solutions that fit within specified geometric constraints. In an exemplary embodiment, the present invention provides a stability solution that meets the geometric constraints associated with the stowed disposition of missiles on the eject launcher of an aircraft where the stability solution is adapted for use during the launch phase and jettisoned subsequent to missile deployment.

In a representative application, an ejectable aerodynamic stability augmentation device using grid fins, in accordance with an exemplary embodiment of the present invention as generally depicted for example in FIG. 1, provides a novel solution for passive static aerodynamic stability control for otherwise uncontrolled store separation. Grid fin 100 comprises a plurality of grid array elements 130, which generally provide turbulation surfaces configured to impart control forces on an attached aeronautic vehicle (e.g., a missile). Accordingly, grid fin 100 generally permits an attached missile to separate from its carrier vehicle in a more controlled fashion as compared with conventional separation techniques. In general, grid fin 100 may be suitably configured to impart aerodynamic stability and/or control forces which are capable of modifying the pitch, yaw and/or roll of the aeronautic vehicle attached thereto, as well as the lift or drag.

Conventional missile deployment systems have utilized autopilot systems to steer missiles away from their associated carrier vehicles; however, launch separation safety issues related to missile stability immediately incident upon separation have generally remained unaddressed. Specifically, the center of gravity of the missile must generally be concurrently disposed substantially in front of the center of pressure in order to accomplish a clean separation from the carrier vehicle.

In accordance with a representative embodiment of the present invention, grid fin 100 may be configured to dispose the center of gravity of a missile substantially in front of the center of pressure in order to produce adequate lift concurrent with separation so as to maintain the pitch orientation of the missile during the separation sequence. When the separation sequence is substantially complete, grid fin 100 may be ejected to permit the air-vehicle to proceed with its mission.

Grid fin 100 may be configured with engagement/dis-engagement mechanisms for releasable attachment to a missile or other aeronautic vehicle. In general, this may be accomplished with a ball-lock, exploding bolt or other release mechanism, whether now known or otherwise hereafter described in the art. Ejectable release of grid fin 100 from the missile may be actuated by a sensor or other device responsive to, for example: baric pressure; relative orientation of the missile (or other aeronautic vehicle); relative orientation of grid fin 100; a timing sequence; GPS data; and/or remote controlled deployment. It will be appreciated, however, that a variety of other release actuation mechanisms may be alternatively, conjunctively or sequentially employed to produce a substantially similar result in accordance with various other embodiments of the present invention.

A variety of grid fin geometries may be employed. For example, grid fin 100 may comprise planar shape or a planar shape. For example, grid fin 100 may comprise a regular solid, an irregular solid, a regular polygon, an irregular polygon or a circular shape. Additionally, the grid fin geometry may have a point, line and/or plane of symmetry. In the case of the grid fin 100 generally depicted in the Figures, the geometry may conform, for example, to the $C_{2v}$ point group.

Furthermore, the geometry of grid fin 100 may comprise occlusion areas 110, 120 to accommodate packing of a plurality of missiles or other attached stores. In the case of a plurality of missiles, occlusion areas 110, 120 may be configured to permit stored disposition of the missiles, for example, on an eject rail of an aircraft without the missile body fins contacting or otherwise substantially impeding the deployment of grid fins 100 corresponding to proximately disposed missiles. For example, the 'snow angel' shape representatively depicted in the Figures, generally provides a grid fin geometry suitably adapted for mounting a trio of missiles on the triple eject rail of a fighter/bomber aircraft.

It will be appreciated that various embodiments of the present invention may find useful application with a variety of aeronautic vehicles including, for example: missiles; bombs; munitions; sub-munitions; rockets; pods; sub-vehicles and/or the like.

In the foregoing specification, the invention has been described with reference to specific exemplary embodiments; however, it will be appreciated that various modifications and changes may be made without departing from the scope of the present invention as set forth in the claims below. The specification and Figures are to be regarded in an illustrative manner, rather than a restrictive one and all such modifications are intended to be included within the scope of the present invention. Accordingly, the scope of the invention should be determined by the claims appended hereto and their legal equivalents rather than by merely the examples described above.

For example, the steps recited in any method or process claims may be executed in any order and are not limited to the specific order presented in the claims. Additionally, the components and/or elements recited in any device claims may be assembled or otherwise operationally configured in a variety of permutations to produce substantially the same result as the present invention and are accordingly not limited to the specific configuration recited in the claims.

Benefits, other advantages and solutions to problems have been described above with regard to particular embodiments; however, any benefit, advantage, solution to problem or any element that may cause any particular benefit, advantage or solution to occur or to become more pronounced are not to be construed as critical, required or essential features or components of any or all the claims.

As used herein, the terms "comprise", "comprises", "comprising", "having", "including", "includes" or any variation thereof, are intended to reference a non-exclusive inclusion, such that a process, method, article, composition or apparatus that comprises a list of elements does not include only those elements recited, but may also include other elements not expressly listed or inherent to such process, method, article, composition or apparatus. Other combinations and/or modifications of the above-described structures, arrangements, applications, proportions, elements, materials or components used in the practice of the present invention, in addition to those not specifically recited, may be varied or otherwise particularly adapted to specific environments, manufacturing specifications, design parameters or other operating requirements without departing from the general principles of the same.

We claim:

1. A grid fin device for use with an aeronautic vehicle, said device comprising:

a grid array structure suitably adapted for releasable engagement with said aeronautic vehicle; wherein said grid array is configured to provide control forces for modifying the flight performance characteristics of the engaged combination of said grid fin with said aeronautic vehicle as compared with the flight performance characteristics of said aeronautic vehicle alone;

wherein said grid array comprises a lobed configuration corresponding to a $C_{2v}$ point group with laterally disposed occlusion areas, non-textured areas, and a central aperture; and said grid array is configured to maintain its aerodynamic disposition with respect to the longitudinal axis of said aeronautic vehicle when engaged to said aeronautic vehicle.

2. The grid fin device of claim 1, wherein said grid array structure is further configured for release from said aeronautic vehicle subsequent to deployment of the engaged combination of said grid fin and said aeronautic vehicle.

3. The grid fin device of claim 1, wherein said control forces are suitable for modifying at least one of pitch, yaw and roll of the engaged combination of said grid fin and said aeronautic vehicle.

4. The grid fin device of claim 1, wherein said control forces are suitable for modifying at least one of drag and lift of the engaged combination of said grid fin and said aeronautic vehicle.

5. The grid fin device of claim 1, wherein said grid array structure substantially conforms to a geometry comprising at least one of:

a regular solid;

an irregular solid;

a regular polygon;

an irregular polygon;

a non-planar geometry having at least one of a point, line and plane of symmetry; and a planar geometry having at least one of a point, line and plane of symmetry.

6. The grid fin device of claim 1, wherein said releasable engagement is accomplished with at least one of a ball-lock and an exploding bolt.

7. The grid fin device of claim 6, wherein release is actuated by at least one of baric pressure, relative orientation of said aeronautic vehicle, relative orientation of said grid array structure, timing sequence, GPS and remote control.

8. The grid fin device of claim 1, wherein said aeronautic vehicle comprises at least one of a missile, a bomb, a munition, a sub-munition, a rocket, a pod and a sub-vehicle.

9. A method for stabilizing an aeronautic vehicle, said method comprising the step of providing a grid array structure suitably adapted for releasable engagement with said aeronautic vehicle; wherein said grid array is configured to provide control forces for modifying the flight performance characteristics of the engaged combination of said grid fin with said aeronautic vehicle as compared with the flight performance characteristics of said aeronautic vehicle alone;

wherein said grid array comprises a lobed configuration corresponding to a $C_{2v}$ point group with laterally disposed occlusion areas, non-textured areas, and a central aperture; and said grid array is configured to maintain its aerodynamic disposition with respect to the longitudinal axis of said aeronautic vehicle when engaged to said aeronautic vehicle.

10. The method of claim 9, further comprising the step of releasing said grid array structure from said aeronautic vehicle subsequent to deployment of the engaged combination of said grid fin and said aeronautic vehicle.

11. The method of claim 10, wherein the step of releasing is accomplished with at least one of a ball-lock and an exploding bolt.

12. The method of claim 11, wherein said release is actuated by at least one of baric pressure, relative orientation of said aeronautic vehicle, relative orientation of said grid array structure, timing sequence, GPS and remote control.

13. The method of claim 9, further comprising the step of altering at least one of pitch, yaw and roll of the engaged combination of said grid fin and said aeronautic vehicle.

14. The method of claim 9, further comprising the step of altering at least one of drag and lift of the engaged combination of said grid fin and said aeronautic vehicle.

15. The method of claim 9, wherein the step of providing a grid array structure comprises the step of providing a geometry for the grid array that substantially conforms to at least one of:

a regular solid;

an irregular solid;

a regular polygon;

an irregular polygon;

a non-planar geometry having at least one of a point, line and plane of symmetry; and a planar geometry having at least one of a point, line and plane of symmetry.

16. The method of claim 9, wherein said aeronautic vehicle comprises at least one of a missile, a bomb, a munition, a sub-munition, a rocket, a pod and a sub-vehicle.

17. A grid fin device for use with an aeronautic vehicle, said grid fin device comprising:

a grid array structure suitably adapted for releasable engagement with said aeronautic vehicle;

said grid array structure configured to provide control forces for modifying the flight performance characteristics of the engaged combination of said grid fin with said aeronautic vehicle as compared with the flight performance characteristics of said aeronautic vehicle alone;

said grid array structure configured to maintain its aerodynamic disposition with respect to the longitudinal axis of said aeronautic vehicle when engaged to said aeronautic vehicle;

wherein said grid array comprises a lobed configuration corresponding to a $C_{2v}$ point group with laterally disposed occlusion areas, non-textured areas, and a central aperture; and said grid array structure further comprising an optimized geometry for aggregation of a plurality of aeronautic vehicles in relative close proximity to each other.

18. The grid fin device of claim 17, wherein said grid array geometry comprises at least one of an indentation and an occluded area suitably configured for permitting stored disposition of said plurality of aeronautic vehicles in relative proximity to each other without substantially impeding the subsequent deployment of any of said proximately disposed aeronautic vehicles.

19. The grid fin device of claim 18, further comprising a mounting assembly for providing at least one of aggregation and stored disposition of said plurality of aeronautic vehicles.

20. The grid fin device of claim 19, wherein at least one of:

at least one of said plurality of aeronautic vehicles comprises a missile; and said mounting assembly comprises an eject rail of an aircraft.

21. The grid fin device of claim 20, wherein said optimized grid array geometry comprises a snow angel shape generally configured not to occlude the fins of a trio of missiles mounted on a fighter/bomber aircraft triple eject rail.

* * * * *